United States Patent [19]

Chern

[11] Patent Number: 4,850,481

[45] Date of Patent: Jul. 25, 1989

[54] CIGARETTE CASE

[76] Inventor: Wen-Bin Chern, No. 122, Kuang-Ming Road, Ta-Chia Chen, Tai-Chung Hsien, Taiwan

[21] Appl. No.: 299,071

[22] Filed: Jan. 19, 1989

[51] Int. Cl.[4] ..... B65D 85/10

[52] U.S. Cl. ..... 206/249; 206/242

[58] Field of Search ..... 206/86, 249, 242, 250

[56] References Cited

U.S. PATENT DOCUMENTS

| | | | |
|---|---|---|---|
| 1,476,652 | 12/1923 | Shorg | 206/249 |
| 2,506,600 | 5/1950 | Kassovic | 206/249 |
| 2,818,970 | 1/1958 | Pough | 206/249 |

FOREIGN PATENT DOCUMENTS

| | | | |
|---|---|---|---|
| 756048 | 5/1933 | France | 206/249 |

*Primary Examiner*—Joseph Man-Fu Moy

*Attorney, Agent, or Firm*—Bacon & Thomas

[57] ABSTRACT

A cigarette case comprises a rectangular frame body, a front cover and an upper cover. The three elements are slidably secured to one another to form a tight enclosure. The frame body includes a front portion, a rear portion and a hollow central portion. The frame body has an elongated slot at a side wall and has a spring-loaded transporting means set in its lower end. A drier storage box with a number of through holes on a front surface thereof is received in the rear portion for absorbing moisture inside the frame body. The front cover includes a side hole on its lower portion for ejecting cigarettes. A switch button of an actuating and lighting means is slidable to uncover the side hole and simultaneously light up a bulb for indicating that the side hole is uncovered.

3 Claims, 5 Drawing Sheets

CIGARETTE CASE

BACKGROUND OF THE INVENTION

This invention relates to a case for storing cigarettes and, more particularly, to a cigarette case which is portable and which ejects cigarettes stores therein by sliding a transporting means and also absorbs moisture within the case by means of a drier box located therewithin.

Cigarettes are easily and frequently damaged from moisture. This deterioration and loss of flavor begins immediately to reduce their quality after they are unpacked and exposed to the atmosphere.

A number of types of cigarette boxes have been widely utilized to store cigarettes. A typical conventional cigarette box is rigid, with a cover provided thereon. The cover is usually openable by a hinge, or slidably openable, to allow access to the cigarettes stores within the box. While this kind of cigarette box works well to a certain degree, it has the inconvenience of requiring the opening of the box and then choosing one cigarette therefrom. This cigarette box may be provided with a drier to protect the cigarettes from moisture but the utilization of the box is still the same, i.e. opening the cover and then retrieving a cigarette.

SUMMARY OF THE INVENTION

In one aspect the invention provides a cigarette case incorporating a mechanism, or means, for ejecting cigarettes by a sliding movement. And at the same time provide a lighting means for indicating this action during the ejection of the cigarettes.

A cigarette case incorporating a drier received in a storage box, in accordance with the present invention, and as necessary as described above, is provided therewithin to aid in absorbing moisture. Therefore, the indicating means for ejection of cigarettes becomes necessary as, it is found, that the cover of the casemay be opened and inadvertently not closed.

The means for ejecting cigarettes is preferably spring-loaded because it is believed to be more convenient.

For convenience in manufacture it is preferred that the cigarette case be assembled from several independent parts and the parts being slidably engageable to form a tight enclosure to prevent moisture from entering.

BRIEF DESCRIPTION OF THE DRAWINGS

The invention will be further described with reference to the accompanying drawings, in which.

DETAILED DESCRIPTION OF THE PREFERRED EMBODIMENT

Figure 1:
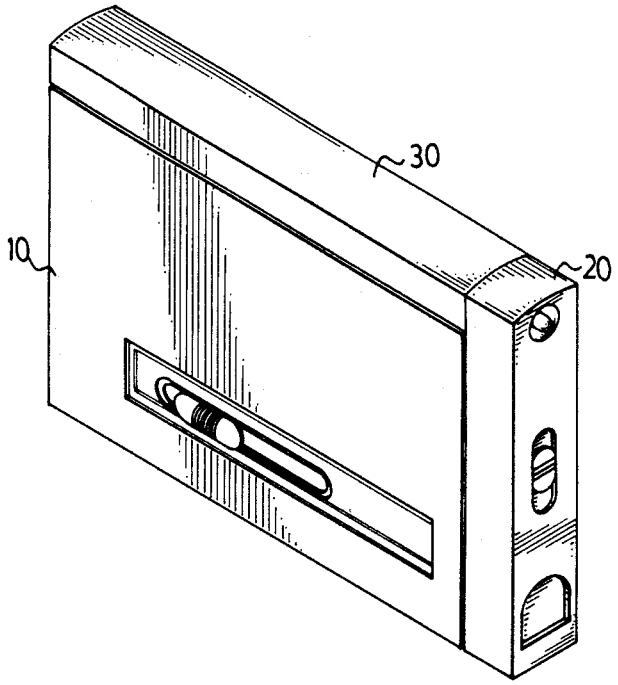
FIG. 1 is a perspective view of a cigarette case in accordance with the present invention.
Figure 2:
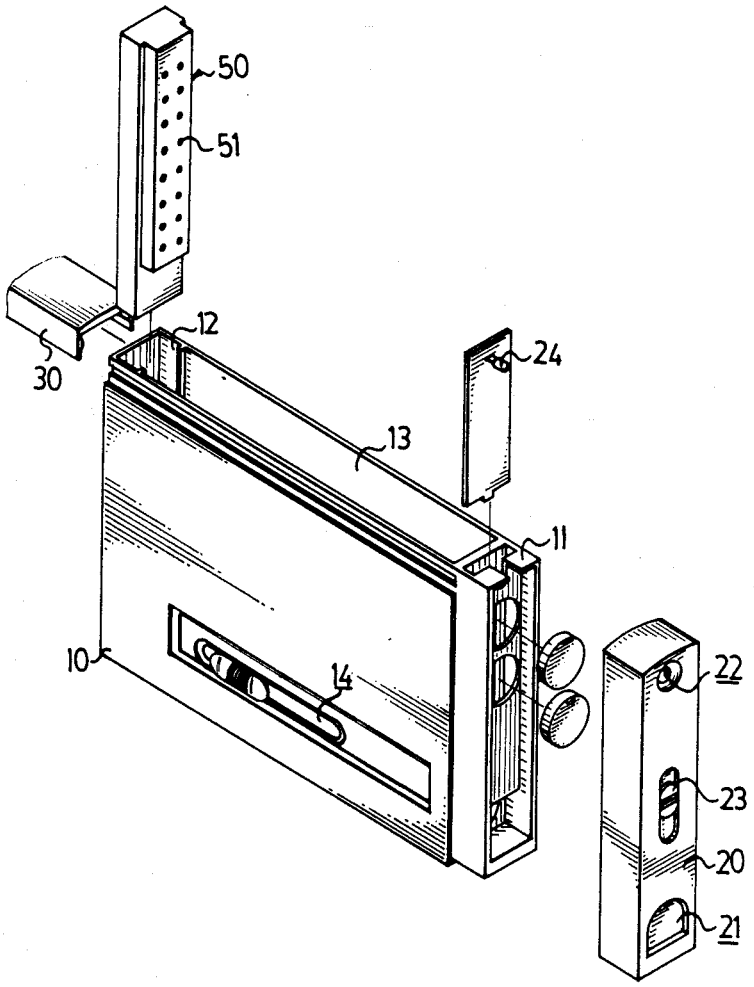
FIG. 2 is an exploded view of the cigarette case of FIG. 1.

Referring to FIGS. 1 and 2, the cigarette case, according to the present invention, comprises a substantially rectangular fram ebody 10, a front cover 20, and an upper cover 30. The above three elements 10, 20a nd 30 are slidably secured to one another to form a tight enclosure. The frame body 10 includes a front portion 11, a rear portion 12 and a hollow central portio 13 and has an elongated slot 14 at a side wall proximate to a lower end thereof.

As shown in FIG. 2, the front cover 20 comprises a side hole 21 on a lower portion thereof for ejecting cigarettes. An actuating and lighting means is disposed within the front portion 11 of the main body 10. The front portion1 1 of the frame body 10 has a corresponding hole on a lower portion thereof which is in line with the side hole 21 such that cigarettesmay be ejected therethrough. A light aperture 22, which is disposed on an upper portion of the front cover 20, is adapted to receive a bulb 24 which is lit via, for example, a pair of dry cell batteries or the like in a way known to those skilled in the art. A drier storage box 50 with a plurality of through holes 51 on a front surface thereof is received in the rear portion 12 of the main body 10 for absorbing moisture inside the main body 10. The upper cover 30 is slidably secured to the frame body 10 at an upper end thereof. Though the cigarette case of the present invention is design to keep the incoming of moisture to a minimum, the drier storage box 50 further provides a complete absorption of moisture.

Figure 3:
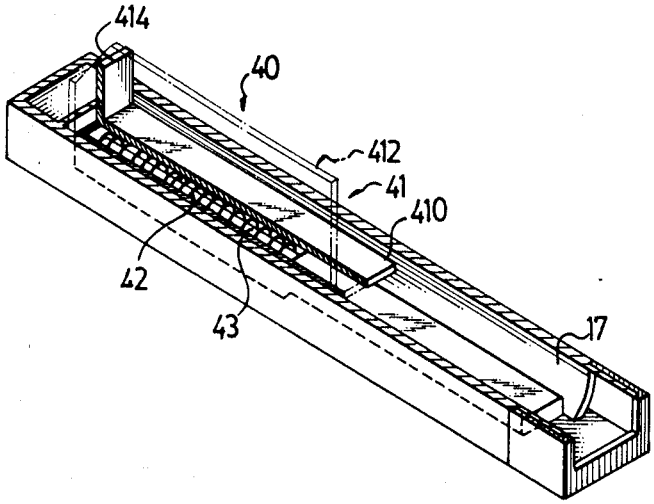
FIG. 3 is a partially cut away perspective view showing in particular the transporting means of this invention.
Figure 4:
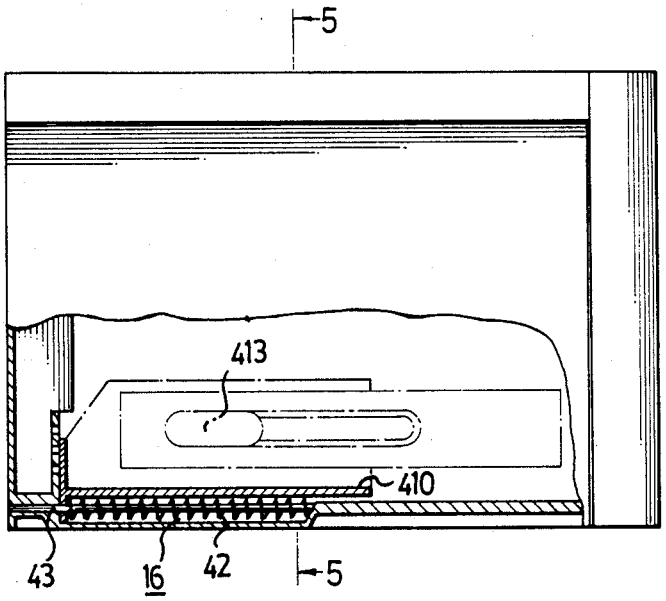
FIG. 4 is a partially cut away sectional side view showing the transporting means of this invention.
Figure 5:
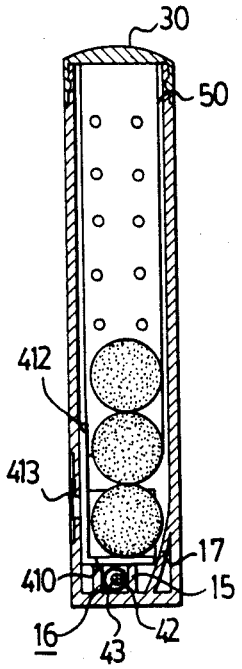
FIG. 5 is a sectional view as seen from the line 5—5 of FIG. 4.

Referring to FIGS. 3 through 5, a spring-loaded transporting means 40 is set within the frame body 10 at its lower end. The transporting means 40 comprises a slider plate 41, a spring 42 and a pin 43. The slider plate 41 comprises a base plate 410, a slide plate 412 and a rear plate 414, as best shown in FIG. 3. The base plate 410 is slidably resting on a pair of flanges 15. The flanges 15 are integrally formed with the frame body 10 and define a horizontal channel 16, as clearly shown in FIG. 5. The side palte 412, which is integrally formed with the slider plate 41 and has a button 413 thereon, is used for covering the elongated slot 14. The rear plate 414 has a lower portion for ejecting cigarettes. The spring 42 is disposed within the horizontal channel 16 and encompasses the pin 43. The pin 43 is fixedly mounted to said frame body 10 along the horizontal channel 16. A switch button 23 of the actuating and lighting means is slidable to uncover the side hole 21 and simultaneously light up a bulb 24 in the actuating and lighting means for indicating that the side hole 21 is uncovered. When the cigarette is ejected by sliding the slider plate 41 forwardly, the spring 42, which is compressed by the lower portion of the rear plate 414, will exert a restoring force to return the transporting means 40 to its original position.

As shown in FIG. 5, an arcuate guiding plate 17 opposite to the side wall may be preferably disposed within the frame body 10. The arcuate guiding plate 17 accurately guides one and only one cigarette to be ejected at a time. The cigarettes are stored within the frame body 10 and the one to be ejected; i.e., the bottom one, rests upon the base plate 410 of the slider plate 41 with the other cigarettes statcked one by one upwardly and sidewardly to achieve optimal storage capacity.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A ciagarette case comprising a substantially rectangular frame body (10), a front coer (20), andn an upper cover (30); said frame body (10) including a front portion (11), a rear portion (12) and a hollow central portion (13); said frame body (10) having an elongated slot (14) at a side wall proximate to a lower end thereof and having a spring-loaded transporting means (40) set therein at said lower end thereof; said upper cover (30) being secured to said frame body (10) at an upper end thereof; said front cover (20) comprising a side hole (21) on a lower portion thereof for ejecting cigarettes, and a light aperture (22) on an upper portion thereof; a drier storage box (50) with a plurality of through holes (51) on a front surface thereof being received in said rear portion (12) of said main body (10) for absorbing moisture inside said main body (10); an actuating and lighting means being disposed within said front portion (11) of said main body (10);

said cigarette case being characterized in that a switch button (23) of said actuating and lighting means is slidable to uncover said side holes (21) and simultaneously light up a bulb (24) in said actuating and lighting means for indicating that said side hole (21) is uncovered.

2. A cigarette case as claimed in claim 1, wherein said transporting means (40) comprises a slider plate (41), a spring (42) and a pin (43), said cigarette case being characterized in that: said slider plate (41) comprises a base plate (410), a side plate (412) and a rear plate (414) with said base plate (410) slidably resting on a pair of flanges (15), said flanges (15) being integrally formed with said frame body (10) and defining a horizontal channel (16), said side plate (412) having a button (413) which is intnegrally formed with said slider late (41) for covering said elongated slot (14), said rear plate (414) having a lower portion for compressing said spring (42) and an upper portion for ejecting cigarettes, said spring (42) being disposed within said horizontal channel (16) and encompassing said pin (43), said pin (43) being fixedly mounted to said frame body (10) along said horizontal channel (16).

3. A cigarette case as claimed in claim 2 characterized in that an aarcuate guiding plate (17) opposite to said side wall is disposed within said frame body (10) for accurately guiding a cigarette to be ejected one and only one at a time.

* * * * *